United States Patent [19]

Ellis

[11] 4,078,362

[45] Mar. 14, 1978

[54] PRODUCT WRAPPING AND DISCHARGE APPARATUS

[75] Inventor: James R. Ellis, Cypress, Calif.

[73] Assignee: Le Roy Enterprises, Inc., Los Alamitos, Calif.

[21] Appl. No.: 778,017

[22] Filed: Mar. 16, 1977

[51] Int. Cl.[2] ..... B65B 11/18

[52] U.S. Cl. ..... 53/222; 53/226

[58] Field of Search ..... 53/220, 221, 222, 223, 53/226, 228

[56] References Cited

U.S. PATENT DOCUMENTS

| | | | |
|---|---|---|---|
| 3,339,339 | 9/1967 | Hull et al. | 53/223 |
| 3,662,513 | 5/1972 | Fabbri | 53/222 X |

*Primary Examiner*—Travis S. McGehee

*Attorney, Agent, or Firm*—Fulwider, Patton, Rieber, Lee & Utecht

[57] ABSTRACT

A product wrapping and discharge apparatus for receiving and wrapping a product such as an ice cream sandwich delivered by a machine of the type which includes a conveyor for carrying the ice cream sandwich to a wrapping station where a wrapper is disposed above the sandwich; an elevator which moves the sandwich upwardly through a wrapping mechanism which folds the wrapper downwardly over the front and rear sides and ends of the sandwich; a pair of end fold tuckers operative to provide end folds; a rear fold paddle operative to provide a rear fold; and a pusher operative to move the sandwich off the elevator and at the same time provide a front fold. The various actuating arms and linkages for the end fold tuckers, rear fold paddle and pusher are mounted just above the wrapping mechanism, thereby minimizing the number and length of actuating arms and linkages required, and consequently achieving a relatively high sandwich wrapping rate. The shape of the end fold tucker cams, and the configuration of the end fold tuckers and elevator, enable the tuckers to more easily and smoothly pass beneath the sandwich during the end fold tucking operation. The reduced vibration greatly increases the speed of the end fold tucking operation.

5 Claims, 16 Drawing Figures

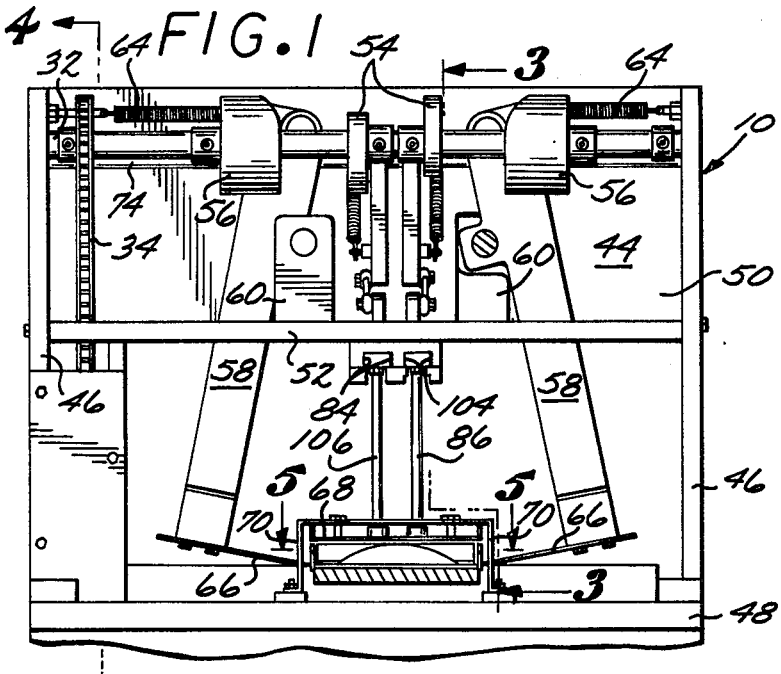
FIG. 1
FIG. 2
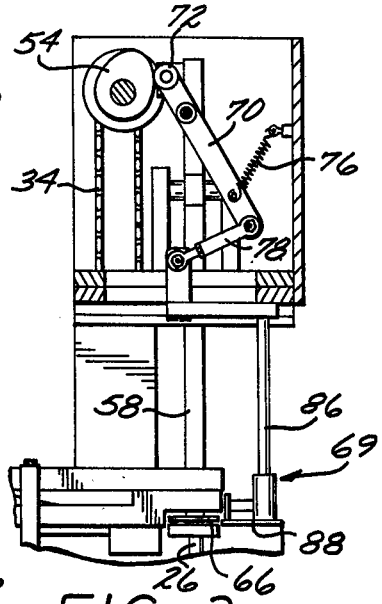
FIG. 3
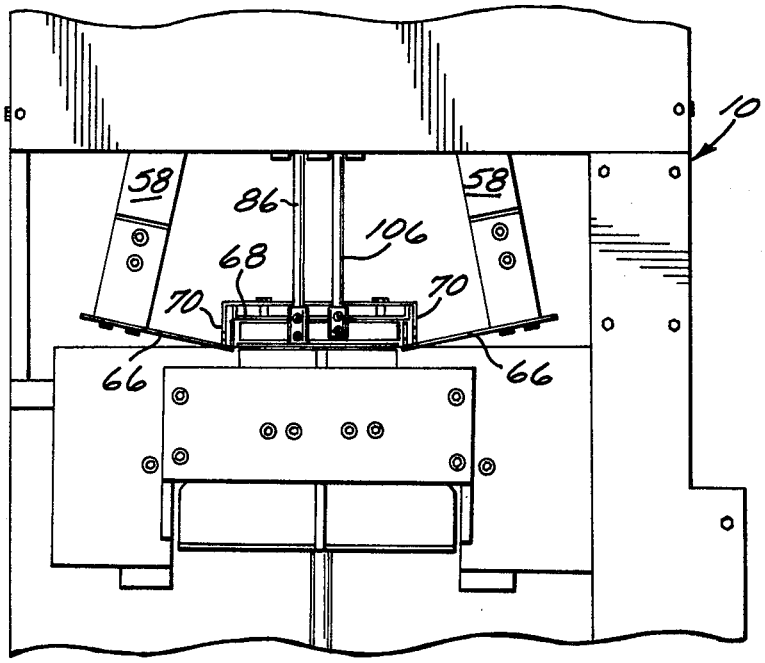
FIG. 4
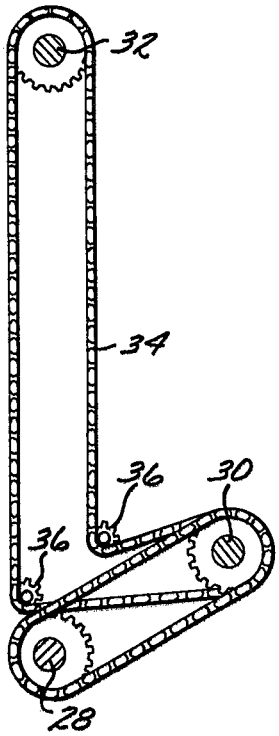
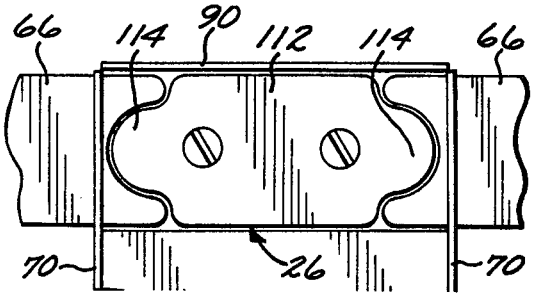
FIG. 5

PRODUCT WRAPPING AND DISCHARGE APPARATUS

BACKGROUND OF THE INVENTION

1. Field of the Invention:

The present invention relates to product wrapping and discharge apparatus for a product such as an ice cream sandwich.

2. Description of the Prior Art:

There are various machines in the prior art for the production manufacture and wrapping of ice cream sandwiches. Typical machines are disclosed in U.S. Pat. Nos. 2,794,404; 3,119,353; 3,316,860 and 3,834,119. These machines are operative to extrude ice cream between a pair of wafers and convey the assembly or sandwich to an elevator located adjacent a mechanism which draws wrapping material from a supply roll and cuts off a segment or wrapper. A wrapping mechanism having specially formed sides defining a wrapper column receives the sandwich and overlying wrapper. An elevator supports the sandwich and moves it through the wrapper column to form front, rear and end folds extending downwardly of the sandwich.

The folding mechanism presently utilized in such machines to move the folds beneath the sandwich prior to sealing is comparatively complex and characterized by long linkages and actuating arms extending from the upper or wrapping area of the sandwich machine to the lower area of the machine where the drive mechanism are located. Such linkages and arms are characterized by a relatively high inertia. Consequently, during a wrapping operation their rapid reciprocation introduces an undesirable vibration which slows the wrapping rate and causes premature wear. In a relatively short time the various pivot points are so worn that the wrapping appaatus is out of adjustment and requires maintenance. Wrapping mechanism of this type slow the wrapping operation to approximately 140 products or sandwiches or less per minute. The enconomics of the market place are such that a higher production rate is desirable.

SUMMARY

According to the present invention, a product wrapping and discharge apparatus is provided for receiving and wrapping a product such as an ice cream sandwich. The apparatus is adapted to fold a wrapper about the ends and rear of a sandwich and thereafter push the sandwich off a wrapping elevator to form the front fold and advance the sandwich to an adjacent area for heat sealing of the wrapper folds.

A pair of end tuckers engage the wrapper and provided the end folds. This is followed by a rear fold paddle which forms the rear fold, and a pusher passes across the wrapper elevator to sweep away the sandwich and form the front fold. The apparatus which actuates the end tuckers, rear paddle, and pusher are all operated by means of a single overhead cam shaft located immediately above the wrapper mechanism and supported by a frame attached to the parent ice cream machine.

The generally vertical alignment of the cam shaft and the wrapping mechanism greatly simplifies the actuation and sequence of operation of the tuckers, paddle and pusher. The location and proximity of the cam shaft to the fold tucking area reduces the lengths of the actuating arms and linkages, reduces the number of such linkages required, and minimizes the mass of the reciprocating components. As a consequence the speed of operation is greatly improved compared to prior art apparatus, being in excess of 200 wrapped products or sandwiches per minute. Moreover, wear is reduced such that a proper state of adjustment can be maintained for significantly long periods.

The end fold tuckers are configured to move into corner recesses specially formed in the wrapping elevator. This, in conjunction with specially shaped end fold tucker cams, allows the end fold tuckers to urge the wrapper end folds beneath the sandwich in one, smooth motion. This feature greatly contributes to a higher speed of operation. Previous machines of the prior art employed a double lobe or other specially shaped cam to move the tucker up to the elevator, cause it to hesitate to allow the elevator to move downwardly, and then move in under the sandwich to perform the folding operation. This rapid start and stop caused vibration and often resulted in bunching and tearing of the wrapper. Location of the cam shaft and associated frame above the wrapping mechanism thus provides a surprising improvement in the speed of operation of the apparatus.

Other objects and features of the invention will become apparent from consideration of the following description taken in connection with the accompanying drawings.

BRIEF DESCRIPTION OF THE DRAWINGS

FIG. 1 is a front elevation view, partly in section, of the present product wrapping and discharge apparatus;

FIG. 2 is a rear elevation view of a portion of the apparatus of FIG. 1;

FIG. 3 is a view taken along the line 3—3 of FIG. 1;

FIG. 4 is a somewhat diagrammatic showing of the drive mechanism for the cam shaft of the present apparatus;

FIG. 5 is an enlarged view taken along the line 5—5 of FIG. 1;

FIG. 9 illustrates the sandwich prior to elevation through the wrapper;

FIG. 10 illustrates the sandwich being elevated through the wrapper;

FIGS. 11 and 12 are side and rear elevational views, respectively, illustrating the end fold tuckers folding the ends of the wrapper beneath the sandwich;

FIG. 13 illustrates the elevator moving downwardly prior to the rear fold operation;

FIG. 14 illustrates the rear fold paddle moving in to fold the rear of the wrapper beneath the sandwich;

FIG. 15 illustrates the pusher moving the sandwich off the wrapper elevator and thereby folding the front of the wrapper beneath the sandwich; and FIG. 16 illustrates the sandwich in position upon an adjacent platform for heat sealing of the wrapper.

DESCRIPTION OF THE PREFERRED EMBODIMENT

Figure 6:
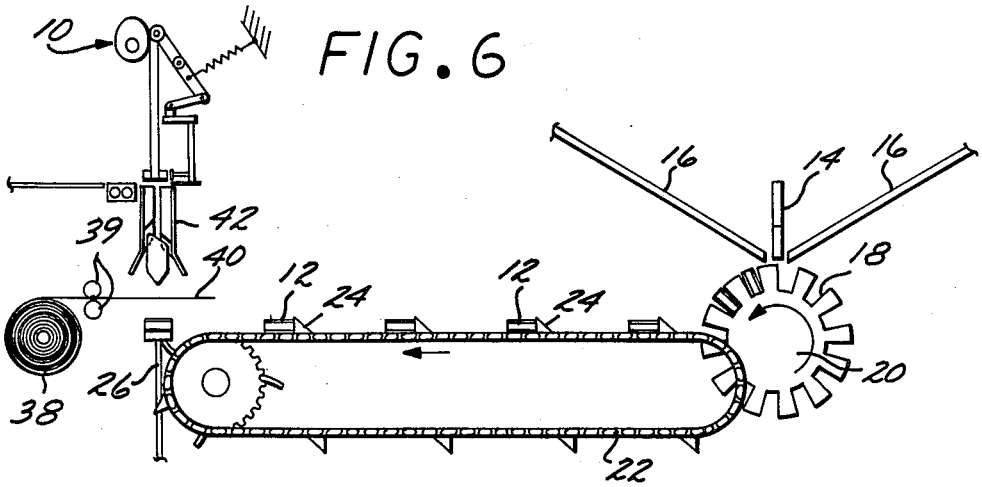
FIG. 6 is a generally diagrammatic view of the main portion of a typical ice cream sandwich machine, illustrating the general relationship of the present apparatus to such a machine.

Referring now to the drawings, and particularly to FIG. 6, there is illustrated a product wrapping and discharge apparatus according to the present invention, and generally designated by the numeral 10. Apparatus 10 is particularly adapted for wrapping a product such as an ice cream sandwich 12 and typical components of an ice cream sandwich machine for conveying sandwiches 12 to the apparatus 10 are illustrated by way of general background. The machine is not part of the present invention and will not be described in detail.

The typical ice cream sandwich machine illustrated includes a supply nozzle 14 for extruding ice cream between a pair of sandwich wafers falling from a pair of adjacent trays 16. The filled sandwich 12 is carried within the slots 18 of a feeding mechanism 20.

Mechanism 20 operates in step-wise fashion, moving each of the sandwiches 12 from the nozzle 14 onto a conveyor 22 at predetermined time intervals. The conveyor 22 includes a plurality of spaced lugs 24 which each carry one of the sandwiches 12. Spool fingers of the conveyor mechanism move the sandwiches 12 onto a wrapper elevator 26.

As diagrammatically shown in FIG. 4, the conveyor 22 is rotated by a sprocket attached to a drive shaft 28 which is coupled to a suitable drive motor. The drive shaft 28 is connected by a chain to a sprocket drive shaft 30. A chain 34, disposed about suitable idlers 36, is driven by the sprocket drive 30 for rotation of a cam shaft 32. The cam shaft 32 is associated directly with the apparatus 10 and will subsequently be described in greater detail.

As seen in FIG. 6, the typical ice cream sandwich machine also includes an appropriately driven roll of wrapping material 38 which is trained between a pair of rolls 39. The rolls 39 are driven in timed relationship to movement of the conveyor 22 and include a suitable slitter which cuts a predetermined section of wrapping material. This constitutes a wrapper 40 for the individual ice cream sandwich, and it is disposed in overlying relation to the sandwich as it is raised by the wrapper elevator.

The elevator 26 moves each sandwich 12 upwardly through the hollow interior or wrapping column defined by the four specially shaped sides of the wrapping mechanism 42. The details of suitable mechanisms such as the mechanism 42 are well known to those skilled in the art and are omitted for brevity. In general, the mechanism 42 is operative to engage the free edge portions of the wrapper 40 and move them downwardly in folded relation as the sandwich 12 moves upwardly through the wrapping column. The mechanism produces a pair of end folds extending downwardly at opposite ends of the sandwich 12, and front and rear folds extending downwardly of the front and rear faces of the sandwich 12. The apparatus 10 of the present invention is designed to engage these wrapper folds and smoothly and quickly move them beneath the sandwich 12, and thereafter move the sandwich 12 off the elevator 26 and onto an adjacent platform for heat sealing of the wrapper to maintain the folds in position. As will be seen, the movement of the sandwich off the elevator 26 is all in a horizontal plane, in a smooth, continuous path.

As previously indicated, the wrapping and discharge apparatus of prior art ice cream machines was coupled to the machine drive motors and shafts below the machine by long linkages and arms. These long linkages and arms produced unwanted vibration and excessive and premature wear, requiring relatively frequent adjustment and maintenance.

With particular reference to FIG. 1-3, the present apparatus 10 includes the cam shaft 32, which is rotated by the drive chain 34, and further includes a frame or supporting structure 44. The structure 44 includes a pair of side plates 46 secured at their bottom edges to a portion of the frame 48 of the ice cream sandwich machine. The structure 44 also includes a backplate 50 to which the rearward edges of the plates 46 are secured. A horizontal plate 52 is bolted at its opposite ends to the side plates 46 a short distance above the frame 48.

The cam shaft 32 is rotatably supported at its opposite ends by the side plates 46 and mounts a pair of generally centrally located cams 54. A pair of barrel cams 56 are also mounted to the shaft 32 laterally outwardly of the cams 54, respectively.

Figure 8:
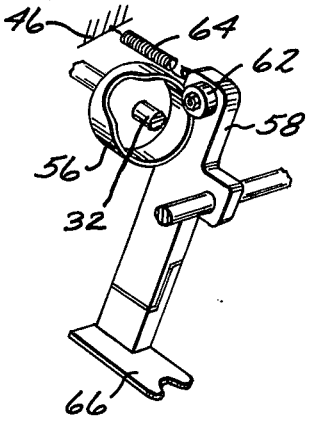
FIG. 8 is a detail perspective view of one of the end fold tuckers and a portion of the associated operating mechanisms.

A pair of generally vertically extending end fold tuckers 58 are pivotally mounted to a pair of trunnion posts 60 which are attached to the horizontal plate 52. As best seen in FIG. 1, the pivotal movement of the end fold tuckers 58 takes place about a pair of parallel, horizontally oriented axes extending in a fore-and-aft direction, that is, out of the plane of the paper in FIG. 1. As also seen in FIG. 8, the upper extremities of the tuckers 58 support cam followers 62 which ride upon the cam surfaces of the associated barrel cams 56. As will be apparent, the surface contour of each cam 56 is made such that the associated tucker 58 is pivoted upon rotation of the cam shaft 32. The pivotal action is laterally in and out toward and away from the vertical path followed by the elevator 26.

Cam followers 62 are spring biased to maintain engagement with the surfaces of the cams 56. This is accomplished by tension springs 64 secured at their inner ends to the upper extremities of the tuckers 58, and at their outer ends to the adjacent side plates 46. The lower end of each tucker 58 includes a flat plate or tucking blade 66, which is horizontally oriented when the tucker 58 is in its position of maximum inward movement toward the elevator 26. The blades 66 are outwardly located in FIG. 1, but FIG. 5 is an illustration of their orientation in their inward positions.

As best seen in FIGS. 1 and 2, the elevator 26 forms the bottom of a folding tunnel when the elevator has reached its uppermost position. The top of the tunnel is formed by an overlying cover 68, while the sides are defined by a pair of vertically oriented side plates 70. The lower portion of the plates 70 includes suitable openings through which the tucking blades 66 can pass during their movement beneath a sandwich 12 located between the elevator 26 and the cover 68.

Figure 7:
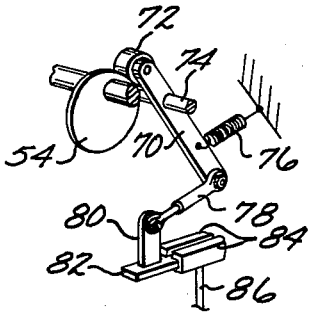
FIG. 7 is a detailed perspective view of a portion of the rear fold paddle and the associated operating mechanism.

The apparatus 10 further includes a rear fold paddle 69 which is actuated by the cam 54 located on the right, as seen in FIG. 1. Rear fold paddle 69 comprises an elongated arm 70, FIGS. 7 and 9, having at its upper extremity a cam follower 72 which rides upon the cam surface of the adjacent cam 54. Arm 70 is pivotably mounted upon a transverse shaft 74, FIG. 1, attached at its opposite ends to the side plates 46. The arm 70 is biased by a tension spring 76 to urge the follower 72 against the cam 54, the spring 76 being secured at one end to the lower extremity of the arm 70 and at the other extremity to the mounting structure back plate 50.

Figure 9:
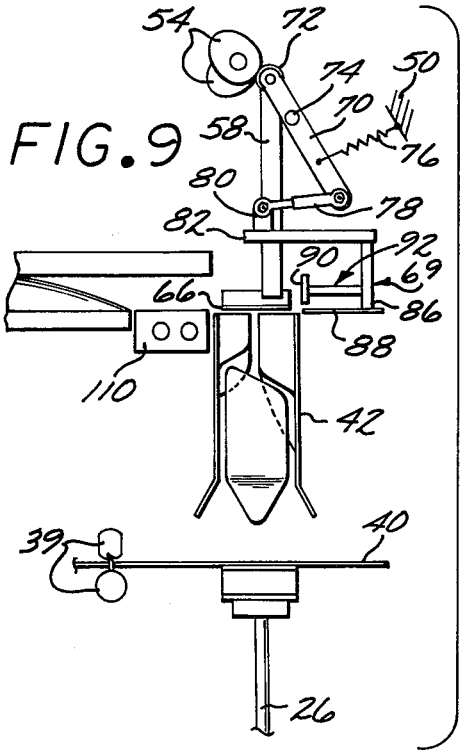
FIGS. 9–16 are generally diagrammatic views illustrating the sequence of wrapping and discharge operations as follows.

The arm 70 is pivoted to one end of a rod 78 which is pivoted at its opposite end to an upright post 80 which extends through and longitudinally reciprocates along the length of a slot provided in the horizontal plate 52. The lower end of the post 80 is secured to an element 82 longitudinally slidable within a pair of ways 84 attached to the underside of the horizontal plate 52. A rod 86 extends through the space between the ways 84 and is attached at its upper end to the element 82 and at its lower end to a horizontally oriented plate or paddle 88. The paddle 88 is adapted to pass just beneath the lower edge of a vertically oriented, transversely extending pusher bar 90 forming a part of a pusher 92, as will be seen. In addition, the paddle 88 is at a lower elevation compared to the elevation of the fingers 66 in their inward positions, as seen in FIG. 9, to avoid striking the fingers 66 during the end and rear fold tucking operations.

Figure 14:
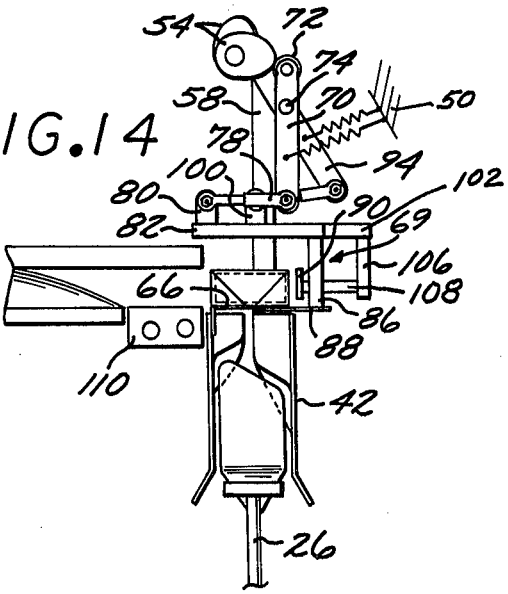
Figure 15:
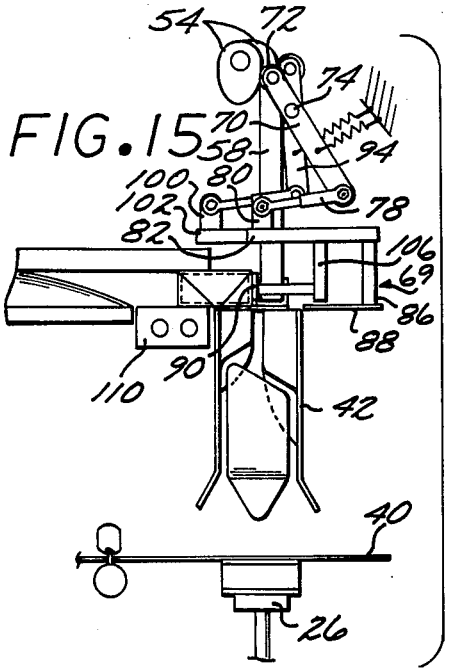
Figure 16:
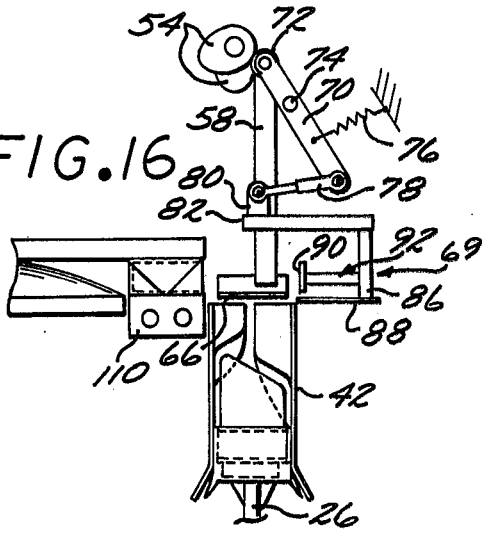

The pusher 92 is constructed and operated in a manner analagous to the construction and operation of the rear fold paddle 69. More particularly, the pusher 92 includes an elongated arm 94, as seen in FIG. 14, pivoted upon the shaft 74 and biased by a tension spring 96 so that a cam follower 98 on the upper extremity of the arm 94 is urged against the surface of the adjacent cam 54. The spring 96 is connected at one end to the arm 94 and at the opposite end to the mounting structure back plate 50. Like the rear fold paddle 69, the pusher 92 includes a vertical post 100 which extends downwardly through a longitudinal slot formed in the horizontal plate 52. The post 100 is secured at its lower end to an element 102 which rides between and is s supported by a pair of ways 104 for longitudinal reciprocal movement. A rod 106 extends downwardly from the element 102, between the ways 104, and is attached at its lower end to a longitudinally oriented push rod which is secured at its forward end to the pusher bar 90.

As best seen in FIGS. 9–16, the apparatus 10 performs the desired folding operations in a particular sequence. Beginning with FIG. 9, the cams 54 and the barrel cams 56 are oriented to urge the associated rear fold paddle 69, pusher 92, and end fold tuckers 58 outwardly and away from the area of the elevator 26.

Figure 10:
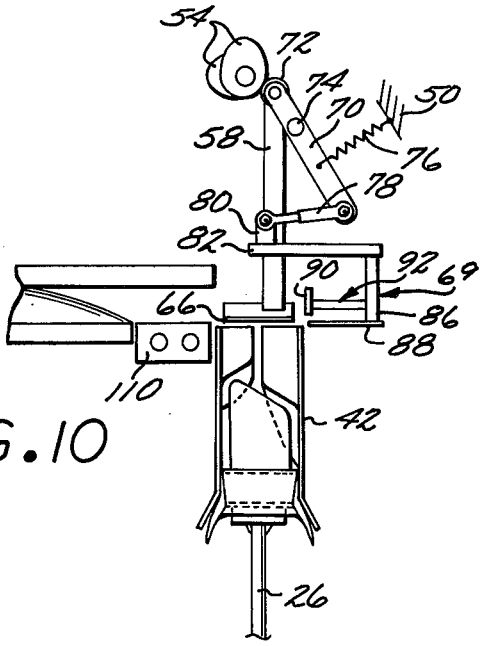
Figure 11:
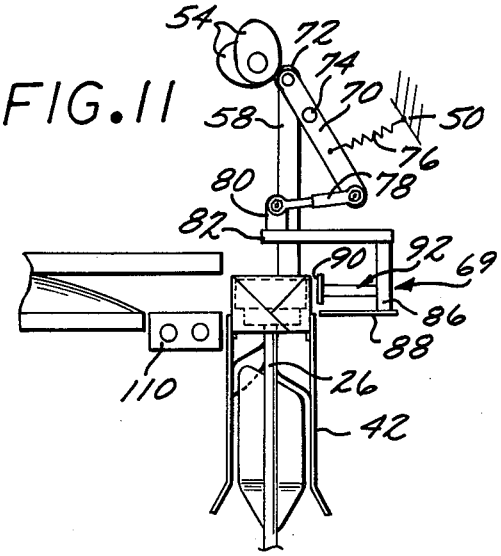
Figure 12:
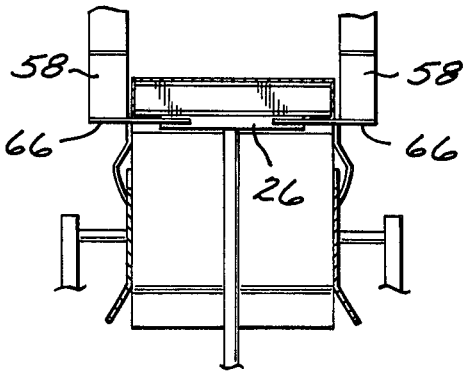

FIG. 10 illustrates the elevator 26 moving a sandwich 12 upwardly toward the area adjacent the tuckers 58, paddle 69 and pusher 92. In FIGS. 11 and 12 the elevator 26 is in its uppermost position and cam followers 62 of the end fold tuckers 58 are located on the most laterally outwardly located portions of the cam surfaces of the cams 56. Consequently, the lower ends or blades 66 of the end fold tuckers 58 are now located beneath the sandwich 12 and have folded the end folds of the wrapper 40 under the sandwich 12.

Figure 13:
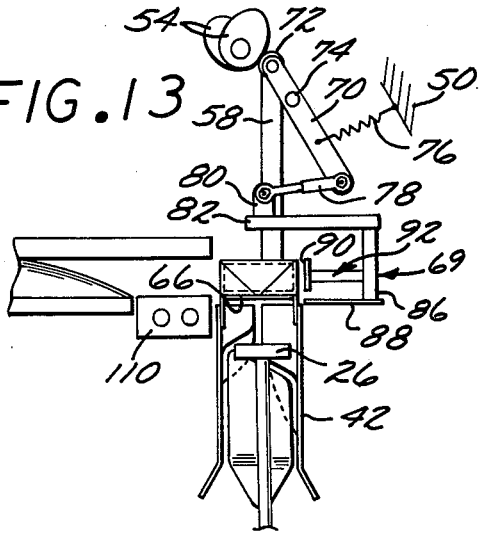

FIG. 13 illustrates the elevator 26 moving downwardly. At this time the sandwich 12 is supported upon the end fold tucker blades 66, and the finger 88 of the rear fold paddle 69 is about to be moved inwardly. In FIG. 14 the finger 88 has moved inwardly along a horizontal axis to a position beneath the blades 66, completing the rear fold. The rear fold paddle 69 next moves rearwardly and the pusher 92 is next operated to push the sandwich 12 onto a heating platform 110 within which are located appropriate heating elements (not shown). Heat from these elements melts the usual adhesive coating on the wrapper 12, and continued movement of the sandwich to the left, as viewed in FIGS. 15 and 16, takes place between upper and lower surfaces (only partially shown) which lightly press against the sandwich and maintain the folds in position during cooling or setting of the adhesive material.

As will be apparent to those skilled in the art, the shape or configuration of the various cam surfaces of the cams 54 and 56, and their relative positions on the cam shaft 32, are such that the above-described and illustrated operations of the end fold tuckers 58, rear fold paddle 69 and pusher 92 take place in the proper sequence and at the proper time.

A particular feature of the invention is the simplification of the operation of the rear fold paddle 58. As best seen in FIG. 5, the upper, horizontally oriented plate 112 of the elevator 26 is cut away at the corners, defining arcuate end sections 114. The inwardly disposed extremities of the end fold tucker blades 66 are complementally configured to fit within these cut away areas. Consequently, the blades 66 are able to move beneath the sandwich 12 while the elevator 26 is still in its uppermost position. This movement takes place in a single, smooth inward sweep. In prior art machines, the tucker blades were characterized by a jerky, two part inward movement. That is, the prior art blades moved in to slightly engage the sandwich ends, the blades then stopped or hesitated to allow the elevator time to move down slightly, and then the blades again moved inwardly to complete their movement under the sandwich. This two-part action required a two-step surface on the associated cam but, most importantly, the jerky action greatly slowed the operation of the associated machine. In the present apparatus the cut away portions of the plate 112, and the complemental configuration of the blades 66, allows the blades to move beneath the sandwich in an interrupted, smooth single sweep. In addition, this smooth action substantially eliminates bunching and tearing of the wrapper during the end fold operation.

Another feature of the present invention is the completely horizontal movement of both the rear fold finger 88 and the pusher bar 90 during the rear fold operation and sandwich movement onto the platform 110. Such horizontal movement is provided by the longitudinal sliding action of the elements 82 and 102 within the ways 84 and 104, respectively. This precise horizontal action provides a smooth, precise entry of the finger 88 beneath the sandwich, without bunching or tearing of the wrapper. Likewise, the horizontal action of the pusher bar 90 provides a precise movement of the sandwich onto the platform 110 upon completion of the folding operation. The precision of these movements greatly enhances the ability of the apparatus 10 to operate at relatively high speeds. In contrast, many devices of the prior art mount the rear fold finger and pusher bar in such a way that they swing through an arc in advancing toward the sandwich. Necessary clearances had to be provided for this type of motion and there was a consequent lack of precision which often resulted in tearing and bunching of the wrapper, particularly at higher speeds of operation.

Of the various features of the invention mentioned, probably the most important to the simplfication of operation of the machine, and its increased production rate, is the provision of a single cam shaft 32 located substantially directly above and in alignment with the vertical path of travel of the elevator 26. The cam shaft 32 is located as close as is conveniently possible to the elevator 26 in its uppermost position to shorten the lengths of the various arms and linkages and yet provide room for the necessary pivotal movements of the wrapping and discharge apparatus components. The tuckers 58 and 68 and the pusher 92 are all actuated by cams mounted on the single cam shaft 32, thereby greatly simplifying the apparatus, as compared to the wrapping and discharge apparatus of prior art ice cream sandwich machines. The size and weight of the moving components of the present wrapping apparatus are greatly reduced, compared to prior art apparatus, thereby reducing the inertia resulting during reciprocation and pivotal movement of such components. Driving of the present apparatus is also simplified, being accomplished by coupling of the cam shaft 32 to the drive mechanisms of the parent ice cream sandwich machine by the single drive chain 34.

As a consequence of the foregoing, the rate of production of the present apparatus is greatly improved over the prior art, a rate of as many as 200 wrapped ice cream sandwiches per minute having been reached. In any event, production rates can be attained well above the 140 pieces per minute which characterize prior art machines.

Various modifications and changes may be made with regard to the foregoing detailed description without departing from the spirit of the invention.

I claim:

1. A product wrapping and discharge apparatus for receiving and wrapping a product such as an ice cream sandwich delivered by a machine of the type which includes: a longitudinally oriented conveyor for carrying the sandwich to a wrapping station where a wrapper is disposed above the sandwich; an elevator which moves the sandwich upwardly through a wrapping mechanism which folds the wrapper downwardly over the front and rear sides and ends of the sandwich; a pair of end fold tuckers operative to fold the wrapper about the ends of and underneath the sandwich; a rear fold paddle operative to fold the wrapper about the rear of and underneath the sandwich; and a pusher operative to move the sandwich off the elevator to accomplish folding of the wrapper about the front of and underneath the sandwich, said product wrapping and discharge apparatus comprising:

a frame attached to said machine and pivotally supporting said pair of end fold tuckers, said rear fold paddle and said pusher;

a horizontally oriented, transversely extending cam shaft located above said wrapping mechanism and carried by said frame;

a pair of end fold tucker cams carried by said cam shaft and engaged by said pair of end fold tuckers for operation thereof upon rotation of said cam shaft;

a rear fold paddle cam carried by said cam shaft and engaged by said rear fold paddle cam for operation thereof upon rotation of said cam shaft;

a pusher cam carried by said cam shaft and engaged by said pusher for operation thereof upon rotation of said cam shaft; and drive means for rotating said cam shaft.

2. A product wrapping and discharge apparatus according to claim 1 wherein said elevator includes a horizontally oriented plate having side portions defining spaces adapted to underlie a sandwich resting upon said plate; and wherein said pair of end fold tuckers include inwardly disposed extremities adapted to fit within said spaces, whereby said pair of end fold tuckers are enabled to move beneath the sandwich during location of said elevator in its uppermost position.

3. A product wrapping and discharge apparatus according to claim 2 wherein said end fold tucker cams include camming surfaces operative to effect continuous, uninterrupted inward movement of said end fold tuckers beneath the product in said uppermost position of said elevator.

4. A product wrapping and discharge apparatus according to claim 1 and including means constraining said rear fold paddle to move horizontally during movement thereof toward said sandwich during folding of said wrapper about the rear of and underneath said sandwich.

5. A product wrapping and discharge apparatus according to claim 1 and including means constraining said pusher to move horizontally during movement thereof toward said sandwich during moving of said sandwich off said elevator.

* * * * *